US005092090A

United States Patent [19]

Stump

[11] Patent Number: 5,092,090

[45] Date of Patent: Mar. 3, 1992

[54] SWIMMING POOL CORNER SUN SHADING DEVICE

[76] Inventor: David H. Stump, 2714 W. Terrace Dr., Augusta, Ga. 30909

[21] Appl. No.: 633,398

[22] Filed: Dec. 21, 1990

[51] Int. Cl.[5] ..... E04H 3/16

[52] U.S. Cl. ..... 52/288; 4/506; 52/169.7

[58] Field of Search ..... 47/35, 71; 4/506, 510, 4/513, 613, 612; 52/287, 288, 169.7

[56] References Cited

U.S. PATENT DOCUMENTS

| | | | |
|---|---|---|---|
| 2,094,215 | 9/1937 | Hope | 52/288 |
| 3,304,667 | 2/1967 | Donegan | 52/288 |
| 3,959,830 | 6/1976 | Broek | 52/288 |

*Primary Examiner*—John E. Murtagh

[57] ABSTRACT

A swimming pool corner sun shade device for use on in-ground, vinyl-lined rectangular swimming pools in the shape of a flat generally keyhole-like shaped mat.

3 Claims, 3 Drawing Sheets

SWIMMING POOL CORNER SUN SHADING DEVICE

BACKGROUND OF THE INVENTION

The present Invention relates in general to shading devices, and in particular to a sun shading device of the type used to shade the corners of rectangular, vinyl-lined, in-ground swimming pools.

The damaging effects of the sun's ultraviolet light upon the corner areas of vinyl-lined swimming pools can be a costly consequence for the backyard swimming pool owner. Constant exposure of the vinyl pool liner to the sun's ultraviolet light causes the liner to deteriorate over a period of time, for example, five to ten years, above the water level of the pool. As the vinyl liner deteriorates, it loses its elasticity and dry rots, thusly becoming susceptible to tearing from the stress of the weight of the water pulling at the liner, specifically at the corners of the pool.

Once the vinyl liner begins to tear in the upper corners of said pool, the only repair remedy currently available to the swimming pool owner is to patch the torn liner with a vinyl covering affixed in place with glue. This has proven to be at best a temporary repair to the aforementioned liner.

Eventually, the constant and unyielding weight of the water exceeds the mending ability of the aforecited repair process, and yields to further tearing and re-patching.

Eventually, the aforementioned pool liner becomes irreparable and replacement of the swimming pool liner is necessitated.

SUMMARY OF THE INVENTION

To prevent and/or limit the aforementioned damaging effects of the sun upon vinyl-lined swimming pools, I have achieved the present invention.

Accordingly, the principal object of the present invention is to provide a device for use on swimming pools with vinyl liners to shade a significant portion of the pool's corners from the sun, thereby protecting said liner from sun damage in the area of the pool corners.

It also is an object of the present invention to provide such a device which is of simple, inexpensive construction.

Another object is to provide such a device which, in use, will provide a multipurpose insulating mat that overlays the swimming pool deck surface to place items commonly used around pools such as, but not limited to, plant containers, drinking glasses, ashtrays, and the like.

The foregoing objects can be accomplished by providing a shading device formed into a keyhole-like shape, which when placed on the swimming pool deck at the corners, would overhang the corner and extend down to the water level, thereby shading the vinyl liner behind said shading device.

The upper portion of the shading device, the circular portion of the keyhole shape, would remain on the deck surface providing an insulation mat for plant containers and other previously, described items.

DETAILED DESCRIPTION

Figure 1:
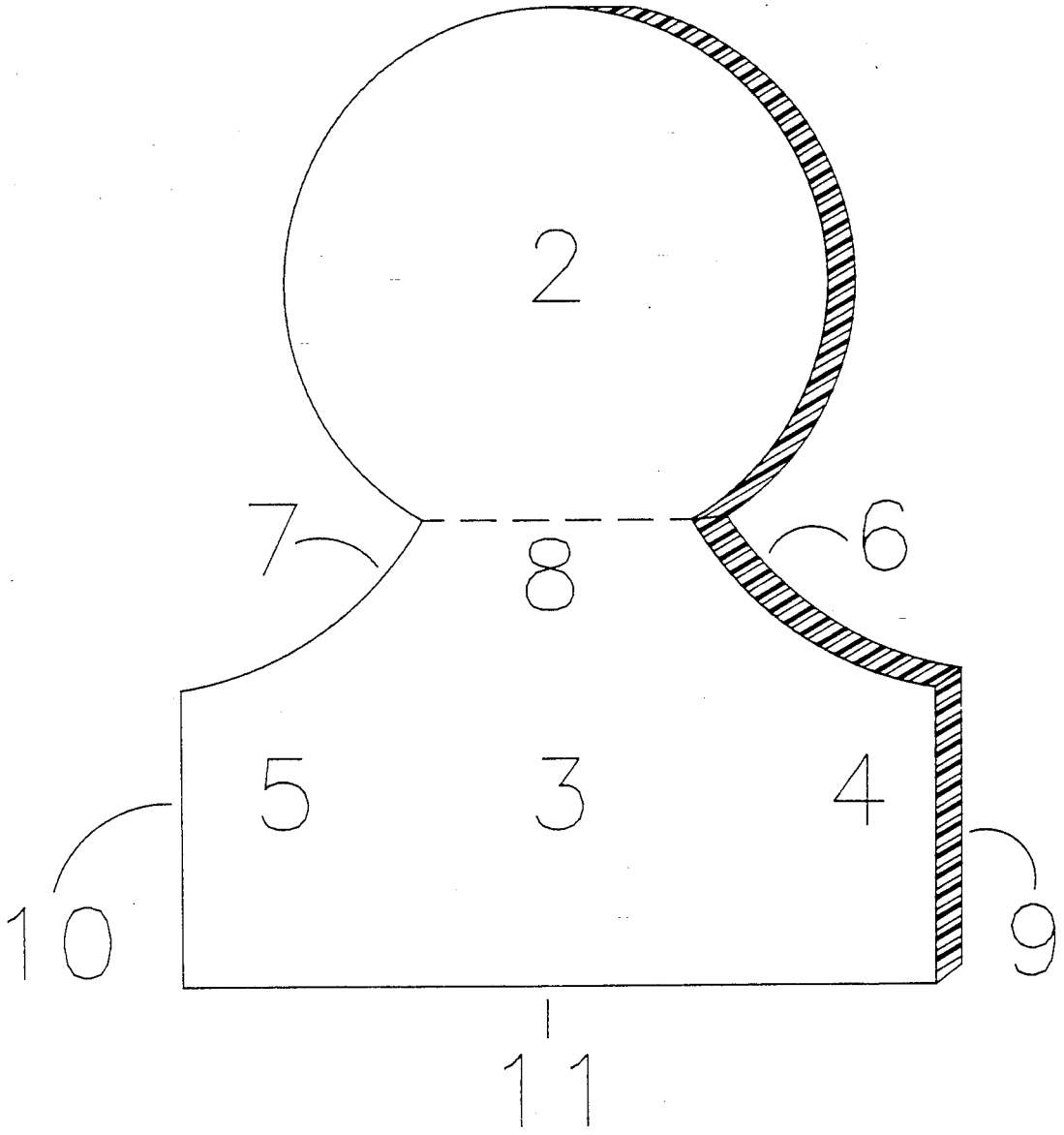
FIG. 1 is the most preferred embodiment of the present invention.

As shown in the drawings, the preferred sun shade device in accordance with the present invention is comprised of a flat mat with front and back surfaces, an upper end portion 2 and a lower end portion 3, which preferably is constructed of a resilient and flexible material. As best seen in FIG. 1, the preferred sun shade device is of a generally keyhole-like shape.

The upper end portion 2 of the sun shade device is of a generally circular shape forming a flat rotary plane.

For illustrative purposes, the sun shade device is bisected by score line 8 at the base of said upper end portion 2.

The lower portion 3 of the sun shade device includes opposite side tabs 4 and 5 respectively, the top edges of which are adjacent to said upper end portion 2 and are curved so as to produce opposite concave edges 6 and 7 respectively. The top edges 6 and 7 of side tabs 4 and 5 are formed as outwardly sloping down from the bisecting score line 8 to a nadir at which point said edges 6 and 7 sharply angle downward forming opposite, parallel vertical sides 9 and 10 respectively. Sides 9 and 10 are connected by a linear edge 11 which is opposite the upper most edge of upper end portion 2 and is parallel to bisecting score line 8. Edge 11 forms the bottom of lower end portion 3 of the device.

Figure 2:
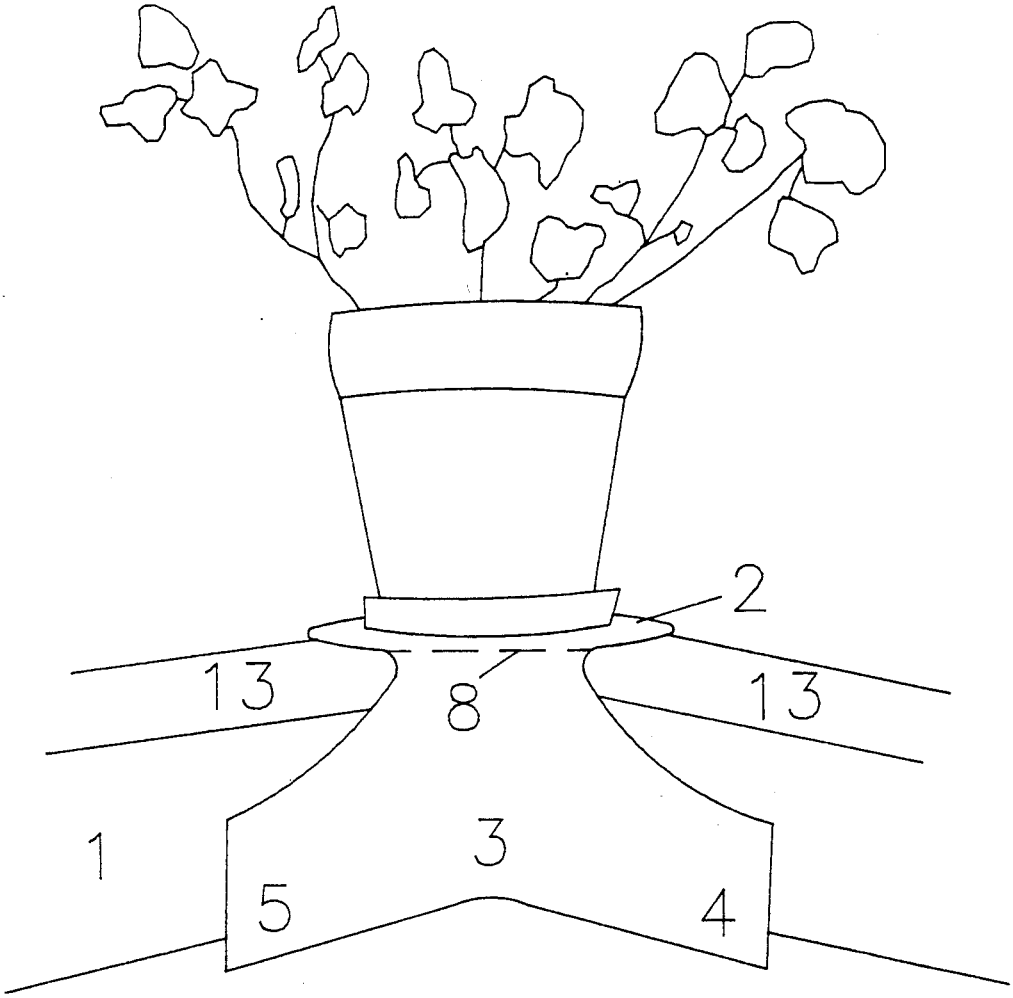
FIG. 2 is a front perspective of the central portion of the device of FIG. 1.
Figure 3:
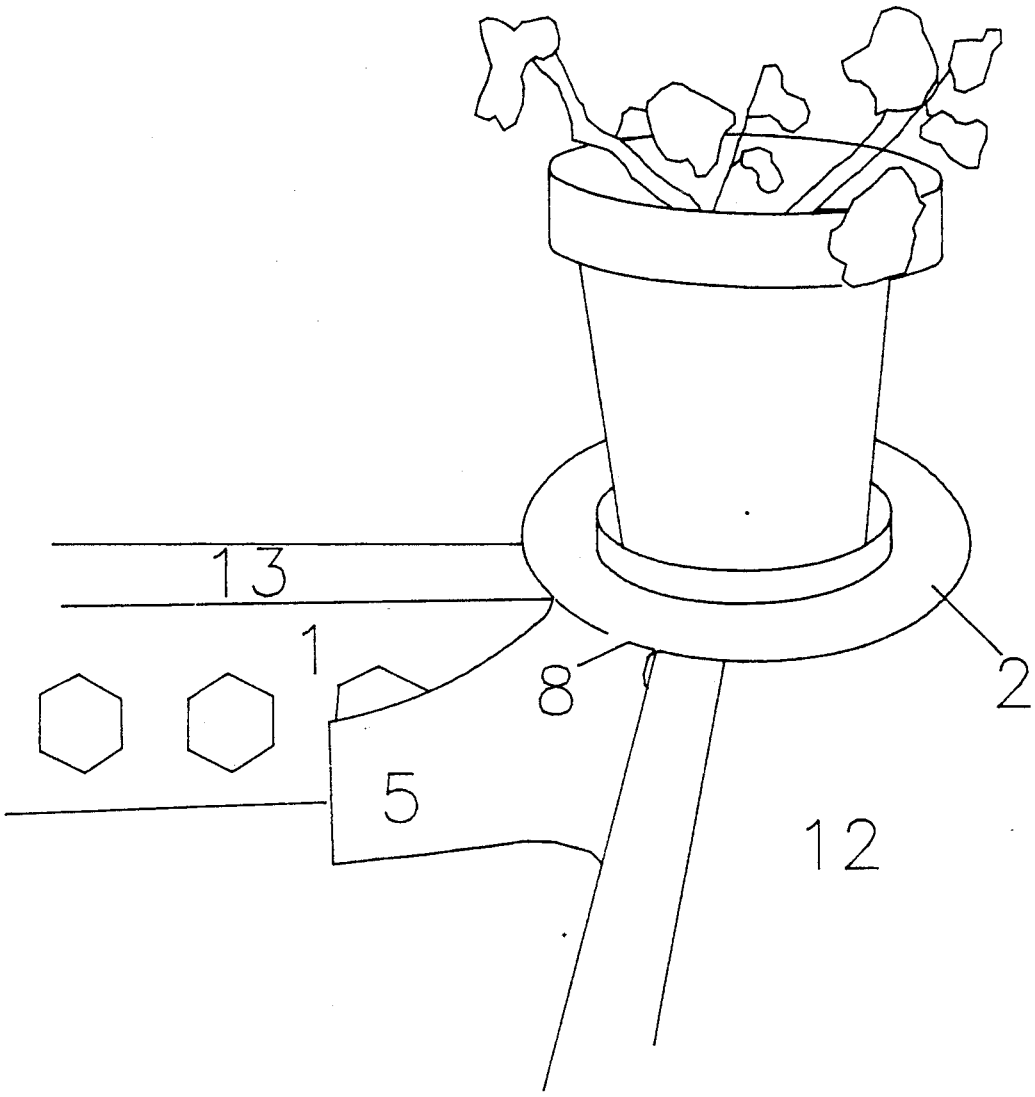
FIG. 3 is a side perspective of the upper portion of such device.

When the sun shade device is to be used the upper end portion 2 will rest flatly on the deck surface 12 of an inground, vinly-lined, rectangular swimming pool 1 adjacent to the corner of said swimming pool 1 as shown in FIGS. 2 and 3.

The force of gravity secures said upper portion 2 in place, said upper portion 2 providing a counterbalance means for supporting said lower portion 3.

The flat mat-like rotary plane surface formed by said upper portion 2 can thusly be optionally used as an insulation mat for placement of plant containers and other swimming pool accessories.

The lower end portion 3 of said device will drape down and over the swimming pool edge 13 at the corner of said swimming pool 1 forming a generally right angle with upper end portion 2 at bisecting score line 8.

It will be noted as clearly illustrated in FIGS. 2 and 3 that the lower end portion 3 of the sun shade device effectively covers and protects a significant portion of the swimming pool corner, thereby, shading said corner from the damaging effects of the sun.

I claim:

1. A sun shade device of a generally flat keyhole-like shape, formed from a resilient and flexible material, for shading and protecting the corners of in-ground, vinyl-lined, rectangular swimming pools comprising an upper end portion 2 of a generally circular shape forming a flat rotary plane, for placement on a swimming pool deck surface 12, a lower end portion 3 including side tabs 4 and 5 with concave upper edges 6 and 7 adjacent to said upper end portion 2 to shade and protect the corners of said swimming pool.

2. The sun shade device of claim 1, further characterized by said upper end portion 2 means to support said lower portion 3.

3. The sun shade device of claim 1, further characterized by said lower portion 3 means for shading and protecting the corners of said swimming pool from the sun.

* * * * *